US008844886B2

(12) United States Patent
Mejia et al.

(10) Patent No.: US 8,844,886 B2
(45) Date of Patent: Sep. 30, 2014

(54) WALL HANGER

(75) Inventors: Edson Mejia, Miami, FL (US); Jonathan Paul Tanger, Plantation, FL (US); David Weck, Miami, FL (US); Steven C. Berenson, Miami, FL (US)

(73) Assignee: The Hillman Group, Inc., Cincinnati, OH (US)

( * ) Notice: Subject to any disclaimer, the term of this patent is extended or adjusted under 35 U.S.C. 154(b) by 487 days.

(21) Appl. No.: 12/391,294

(22) Filed: Feb. 24, 2009

(65) Prior Publication Data

US 2010/0213333 A1 Aug. 26, 2010

(51) Int. Cl.

| | |
|---|---|
| ***A47B 96/06*** | (2006.01) |
| ***A47G 1/22*** | (2006.01) |
| ***A47G 1/16*** | (2006.01) |
| ***A47G 1/20*** | (2006.01) |

(52) U.S. Cl.

CPC ..... *A47G 1/22* (2013.01); *A47G 1/1633* (2013.01); *A47G 1/205* (2013.01); *A47G 1/20* (2013.01)

USPC ..... 248/216.4; 248/217.3; 248/547

(58) Field of Classification Search

CPC ..... A47G 1/16; A47G 1/1606; A47G 1/162; A47G 1/1633; A47G 1/205; A47G 1/1666; A47G 1/20; A47G 1/22

USPC ..... 248/216.1, 216.4, 217.1, 217.2, 217.3, 248/546, 547, 684, 475.1, 489, 498

See application file for complete search history.

(56) References Cited

U.S. PATENT DOCUMENTS

| | | | | |
|---|---|---|---|---|
| 2,841,353 | A | 7/1958 | Burdick | |
| 2,916,235 | A * | 12/1959 | Nagel | 248/497 |
| 4,485,995 | A * | 12/1984 | Hogg | 248/218.1 |
| 4,509,713 | A * | 4/1985 | Hogg | 248/546 |
| 4,619,430 | A * | 10/1986 | Hogg | 248/467 |
| 6,059,124 | A | 5/2000 | Weck et al. | |
| 6,095,465 | A | 8/2000 | Weck et al. | |
| 6,629,680 | B2 | 10/2003 | Weck et al. | |
| 6,695,276 | B2 * | 2/2004 | Skorka | 248/497 |
| 6,758,455 | B2 | 7/2004 | Weck et al. | |
| 7,093,812 | B1 * | 8/2006 | Nordeen | 248/304 |
| 2004/0159766 | A1 | 8/2004 | Skorka | |

* cited by examiner

*Primary Examiner* — Gwendolyn W Baxter

(74) *Attorney, Agent, or Firm* — Lowe Hauptman & Ham, LLP

(57) ABSTRACT

A wallboard wall carries a picture or shelf hanger in a hole between front and back faces of the wall. The hanger includes: a one-piece member having (a) a shoulder having a bottom portion bearing against a bottom portion of the hole and extending horizontally through the hole, (b) an arm extending upwardly from the shoulder, (c) a leg (i) extending downwardly from the shoulder, and (ii) located outside the front face of the wall and (d) a load bearing surface for receiving the object. The arm has a sharp pointed end piercing the back face of the wall and extending into the wall via the back face of the wall.

22 Claims, 14 Drawing Sheets

WALL HANGER

FIELD OF INVENTION

The present invention relates generally to hangers for hanging objects on wallboard walls, and more particularly to such a hanger having a shoulder that extends horizontally through a hole in the wall and includes an arm having a sharp pointed end that pierces the back face of the wall and extends into the wall via the back face.

BACKGROUND ART

Skorka, U.S. Pat. No. 6,695,276 and US Patent Publication 2004/0159766 disclose wall hanger assemblies comprising a clip having a shoulder that extends through a horizontal hole in a drywall wall. (The term drywall is synonymous with the terms wallboard, gypsum board, plasterboard and is known by other names throughout the world.) An arm extends upwardly from the shoulder to abut and engage the interior face of the wall, and seat against the interior face. A leg carrying a hook extends downwardly from the shoulder in front of the exterior face of the wall. Prior to inserting the arm and shoulder through the hole a plate having a slot is slipped over the arm and the shoulder so it is in front of the hook. The combination of the clip and the plate is then inserted into the hole, so that the plate bears against the front face of the wall. The plate and clip are then secured to the wall by driving nails through holes of the plate, thence into and through the front face of the wall.

The hanger disclosed in one embodiment of the Skorka U.S. Patent Publication has been commercialized. It has been found, however, that some installers find this hanger to be difficult to be mounted on a wall because it is difficult to handle the clip and plate, particularly to nailing the plate in place with the clip dangling from it. If the plate is not nailed to the wall, the hanger is essentially useless. In addition, there are increased costs associated with the two-piece arrangement of the clip and plate compared to conventional one piece wall hangers. The maximum weight the commercial device can hold is 200 pounds (90.6 kg), assuming nails are used to hold the plate in place.

SUMMARY OF THE INVENTION

One aspect of the invention relates to the combination of a wallboard wall having a hole therein between front and back faces of the wall and a hanger, fixedly mounted on the wall, for hanging an object on the wall. The hanger comprises: a one-piece member having (a) a shoulder having a bottom portion bearing against a bottom portion of the hole and extending horizontally through the hole, (b) an arm extending upwardly from the shoulder, (c) a leg (i) extending downwardly from the shoulder, and (ii) located outside the front face of the wall, and (d) a load bearing surface for receiving the object. The arm includes a sharp pointed end piercing the back face of the wall and extending into the wall via the back face of the wall.

If the hanger is configured as a picture hanger, there is no need, in at least one embodiment, to nail the leg or any other part of the hanger to the front face of the wall for loads up to 220 pounds (100 kg) because one or more sharp pointed end(s) pierces and extends into the back face of the wall. (It is to be understood that the term "picture hanger" is used generically and that the term picture hanger refers to a hanger for holding any object with a substantially flat back against a wall, such as a picture, mirror, flat panel television receiver or clock.) The holding forces of (1) the sharp pointed end(s) in the wall, through the back face of the wall, and (2) the shoulder bearing against the bottom portion of the hole in the wall are sufficient to hold such a load. If it is necessary to provide greater holding force, e.g., to 260 or 280 pounds (111.2 or 127.3 kg), nails can be hammered into the front face via holes in the leg.

In a first embodiment, the sharp pointed end is at an end of the arm opposite from the shoulder and is tilted slightly toward the wall relative to the remainder of the arm. As a result, the arm extends substantially vertically into the back face of the wall. This embodiment, if configured as a picture hanger wherein the load bearing surface is on a hook on the leg, can hold 260 pounds (111.2 kg) if nails are hammered into the front face through holes in the leg. In a second embodiment, there is at least one, and preferably plural, sharp pointed end(s) that extends substantially horizontally from the arm into the back face of the wall. The second embodiment, if configured as a picture hanger including three sharp pointed ends and a spring arrangement for urging the sharp pointed ends into the back face of the wall, can hold 280 pounds (127.3 kg) if nails are hammered into the front face through holes in the leg. Both of these embodiments, if configured as picture hangers, are one piece members, and thereby overcome the disadvantages of the two piece prior art discussed previously.

The hanger can also be configured so the load bearing surface is on a tongue horizontally aligned with the shoulder and extending away from the wall. In this configuration, the one piece member includes two of said legs. The two legs are outside opposite longitudinally extending walls of the tongue. This configuration can be used with a plate that is primarily used for stabilizing the position of the hanger, and is not part of the one piece member. The plate is fixedly mounted on and bears against the front face of the wall so it is between the front face of the wall and the legs and provides some support for the hanger. The tongue typically supports a shelf, so that in this configuration the hanger is considered a shelf hanger.

Another aspect of the invention relates to a hanger for hanging an object on a wallboard wall having a hole between its front and back faces and through which a portion of the hanger is adapted to extend. The hole is formed either in response to the hanger being inserted through the wall or prior to insertion of the hanger through the hole. The hanger comprises a one-piece member having: (a) a shoulder having a bottom portion adapted to bear against a bottom portion of the hole and to extend horizontally through the hole, (b) an arm extending upwardly relative to the shoulder while the shoulder extends horizontally through the hole, (c) a leg extending downwardly from the shoulder while the shoulder extends horizontally through the hole, and (d) a load bearing surface for receiving the object. The arm includes a sharp pointed end for digging into the back face of the wall while the shoulder extends horizontally through the hole. The arm, shoulder, leg and load bearing surface are arranged so that while the shoulder extends horizontally through the hole and while sufficient weight is applied by the object to the load bearing surface: (a) the leg is outside the front face of the wall, (b) a portion of the shoulder proximate the leg pivots about a segment of the bottom portion of the hole proximate the front face of the wall for causing the leg to pivot toward the front face of the wall, and (c) the arm bears against the back face of the wall for causing the sharp pointed end to dig into the back face of the wall and fixedly hold the arm against the wall in response to the pivoting of the shoulder.

The words "sharp pointed end dig into a wall" and variations thereof such as "sharp pointed end digging into a wall"

as employed in this document mean the initial impaling of a surface of a wall by the sharp pointed end and/or the movement of the sharp pointed end into the wall after the initial impaling. Based on tests and experience, the arm of the previously mentioned commercial hanger does not dig into a wall. The disclosure of the previously mentioned Skorka patent includes no indication that the arm thereof digs into a wall; the patent indicates the arm abuts and engages the interior side of the wallboard and seats against the wallboard. The arm includes a pointed end alleged to facilitate insertion of the element including the arm into the wallboard, that is, through the hole in the wallboard.

In one embodiment of the present invention, the arm includes a spring arrangement between the shoulder and a portion of the arm carrying the sharp pointed end. The spring arrangement preferably has an arcuate shape between the shoulder and the portion of the arm carrying the sharp pointed end. The arcuate shape has curves so that a first portion of the arcuate shape extends from the shoulder to a point beyond the portion of the arm carrying the sharp pointed end and a second portion of the arcuate shape extends from the point to the portion of the arm carrying the sharp pointed end. The spring arrangement is such that in response to the object exerting sufficient load on the load bearing surface a force is exerted on the arm to assist digging of the sharp pointed end into the back face of the wall.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

DETAILED DESCRIPTION OF THE DRAWING

Figure 1:
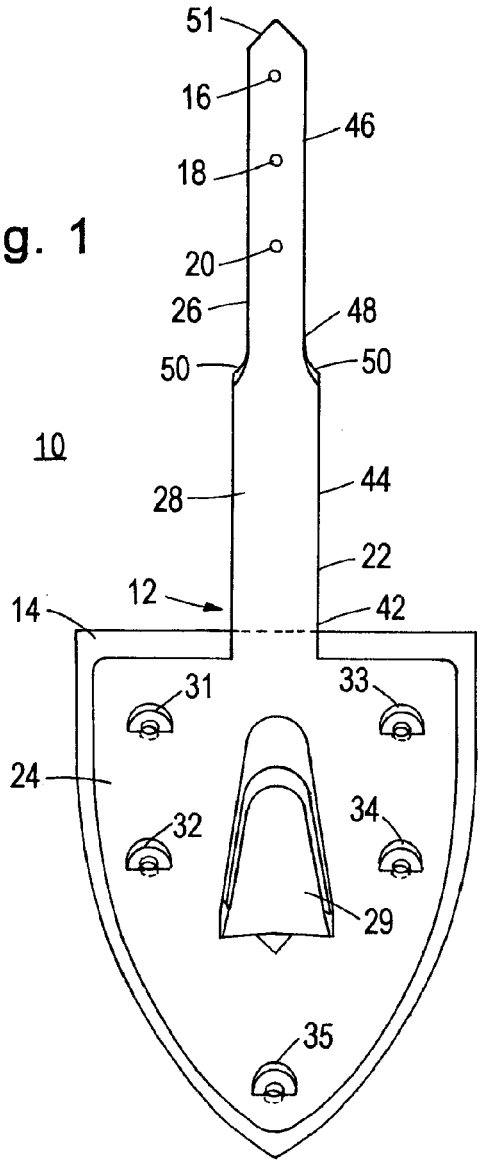
FIG. 1 is a front view of a picture hanger in accordance with one preferred embodiment of the invention.
Figure 3:
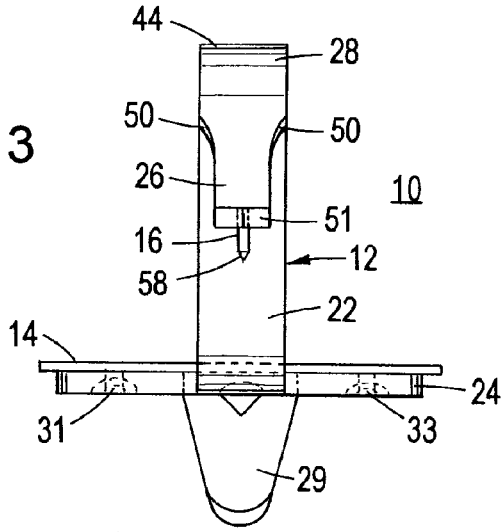
FIG. 3 is a top view of the picture hanger illustrated in FIGS. 1 and 2.

Reference is now made to FIGS. 1-5, drawings of an uninstalled picture hanger 10 found, through experimentation, to hold loads up to 280 pounds (127.3 kg) on a ⅝ inch (1.59 cm) thick drywall wall. Picture hanger 10 consists of one-piece sheet metal structure 12, shock absorbing layer 14, and nails 16, 18 and 20. Shock absorbing layer 14 and nails 16, 18 and 20 are fixedly attached to sheet metal structure 12 that includes planar shoulder 22, planar leg 24, planar arm 26 and arcuate spring 28. In a preferred embodiment, structure 12 is made of 12 gauge (0.109 inch (2.77 mm) thick) low carbon steel coated with brass plating. After a sheet metal blank that is to form structure 12 has been extruded, the blank is stamped and formed to the shape described infra.

When hanger 10 is installed on the drywall wall, shoulder 22 extends generally horizontally through a horizontal hole in the wall, between front and back faces of the wall. Leg 24 is connected to the end of shoulder 22, essentially at the front face of the wall, and then extends vertically down from the end of shoulder, parallel to the front face of the wall against which layer 14 bears. Spring 28 is connected between the end of shoulder 22, essentially at the rear face of the wall, and the bottom of arm 26. Arm 26 extends generally vertically upward, away from shoulder 22 and spring 28, so the arm is along or close to the back face of the wall. Prior to hanger 10 being mounted in the wall, arm 26 is in a plane parallel and displaced from leg 24 by a distance approximately equal to the thickness of the wall.

Shock absorbing layer 14 is in the form of soft rubber or soft high density polyurethane foam, preferably as disclosed by Weck et al., U.S. Pat. Nos. 6,059,124 and 6,095,465, both incorporated by reference herein. Layer 14 is fixedly mounted (glued) on the rear planar face of leg 24, that is, the face of the leg facing toward the drywall on which hanger 10 will be mounted. Layer 14 extends beyond the edges of leg 24, which is shaped as a shield for aesthetic and product identification purposes.

Leg 24 includes tongue 29 that is stamped from the leg to extend from the front generally planar surface of the leg in a direction opposite from the back face of the leg and away from the drywall. Tongue 29 includes load bearing surface 30 for receiving a long narrow structure, such as a metal wire or plastic cord, attached to the object to be hung on hanger 10. Tongue 29 preferably is configured as disclosed by Weck et al., U.S. Pat. Nos. 6,629,680 and 6,758,455, both incorporated by reference herein.

Leg 24 also includes five holes 31-35 through which nails 36-40 (preferably case hardened) are inserted and driven into the drywall behind layer 14. Holes 31 and 32 are on the left side of tongue 29, holes 33 and 34 are on the right side of tongue 29 and hole 35 is directly below the center of tongue 29 which is equally spaced from the side edges of leg 24. Each of holes 31-35 is preferably surrounded by a guide collar, as disclosed by the Weck et al. previously mentioned patents; the collars are not illustrated to provide greater clarity to the drawings. Nails 36-40 are used for maximum loads. If the load is less than the maximum, fewer or no nails may be necessary.

Shoulder 22 is smoothly connected to and angularly displaced from leg 24 by an angle slightly greater than 90 degrees, preferably 94 degrees, as a result of the center of the top edge of leg 24 extending from and being connected to the front portion of shoulder 22 by curved segment 42 of structure 10; shoulder 22 and segment 42 have the same cross sectional rectangular dimensions and geometry. Because of the angle between shoulder 22 and leg 24, when shoulder is horizontally positioned in the hole in the wall and a load is applied to load bearing surface 30, the bottom surface of the shoulder at the front end of the hole, next to the front face of the wall, rests on the bottom surface, i.e., floor, of the hole in the wall, and the top surface of the shoulder at the back end of the hole, next to the back face of the wall, bears against the top surface, i.e., roof, of the hole.

Arcuate spring 28 includes curved portions 44 and 46 that are smoothly connected to each other by straight portion 48, which is essentially an inflection region between the two curved portions. The end region of portion 44 includes inwardly tapered side walls 50 so that the width of curved portion 44 at its intersection with straight portion 48 is less than the width of the curved portion 44 at its intersection with shoulder 22; curved portion 44 and shoulder 22 have the same cross sectional dimensions and geometry at their intersection. Tapered side walls 50 at a portion of spring 28 close to portion 48 assist in inserting shoulder 22 into the hole in the wall by (1) enlarging the hole and (2) conforming the hole to the dimensions of the shoulder after insertion of the shoulder into the hole.

Figure 2:
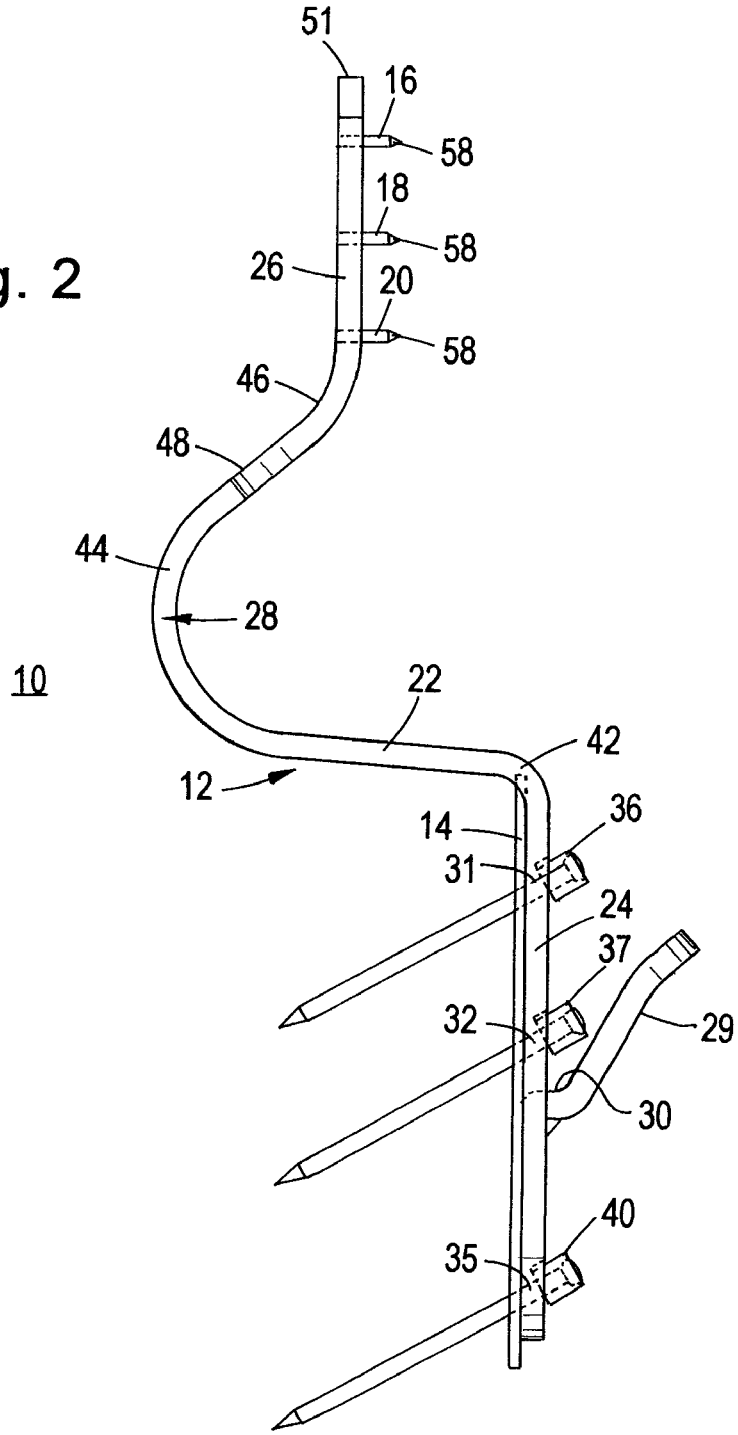
FIG. 2 is a side view of the picture hanger illustrated in FIG. 1.
Figure 4:
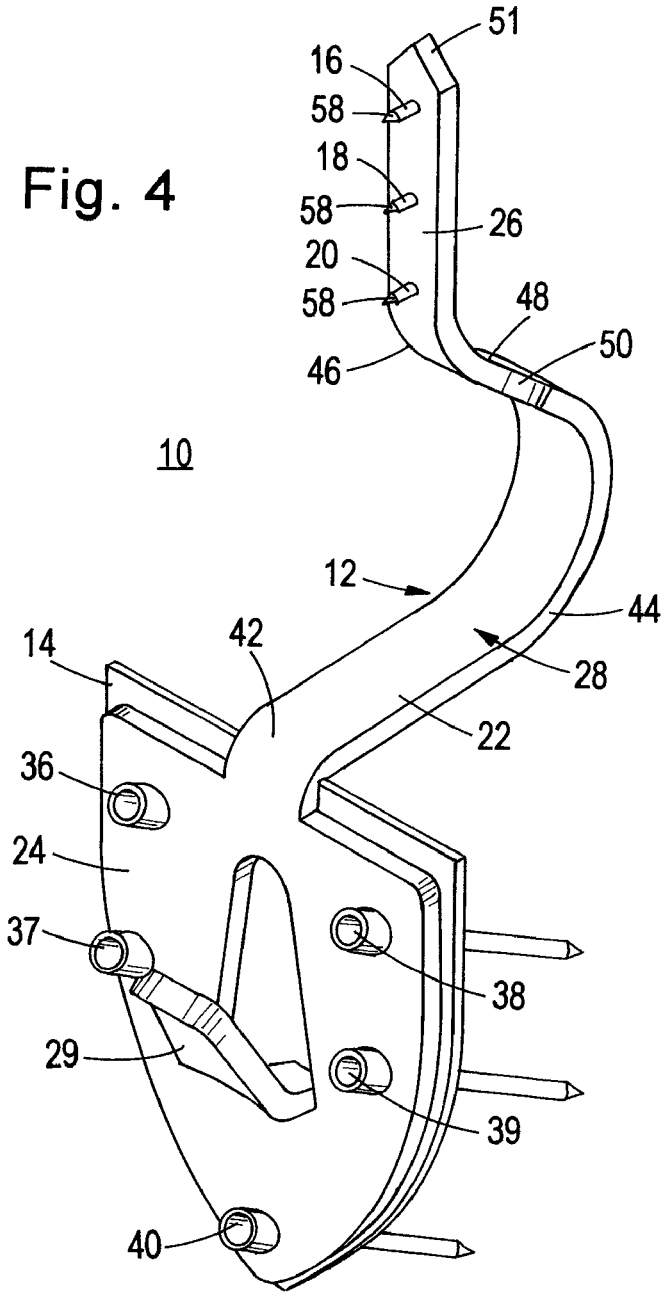
FIG. 4 is a perspective view, from the top, of the picture hanger illustrated in FIGS. 1-3.
Figure 5:
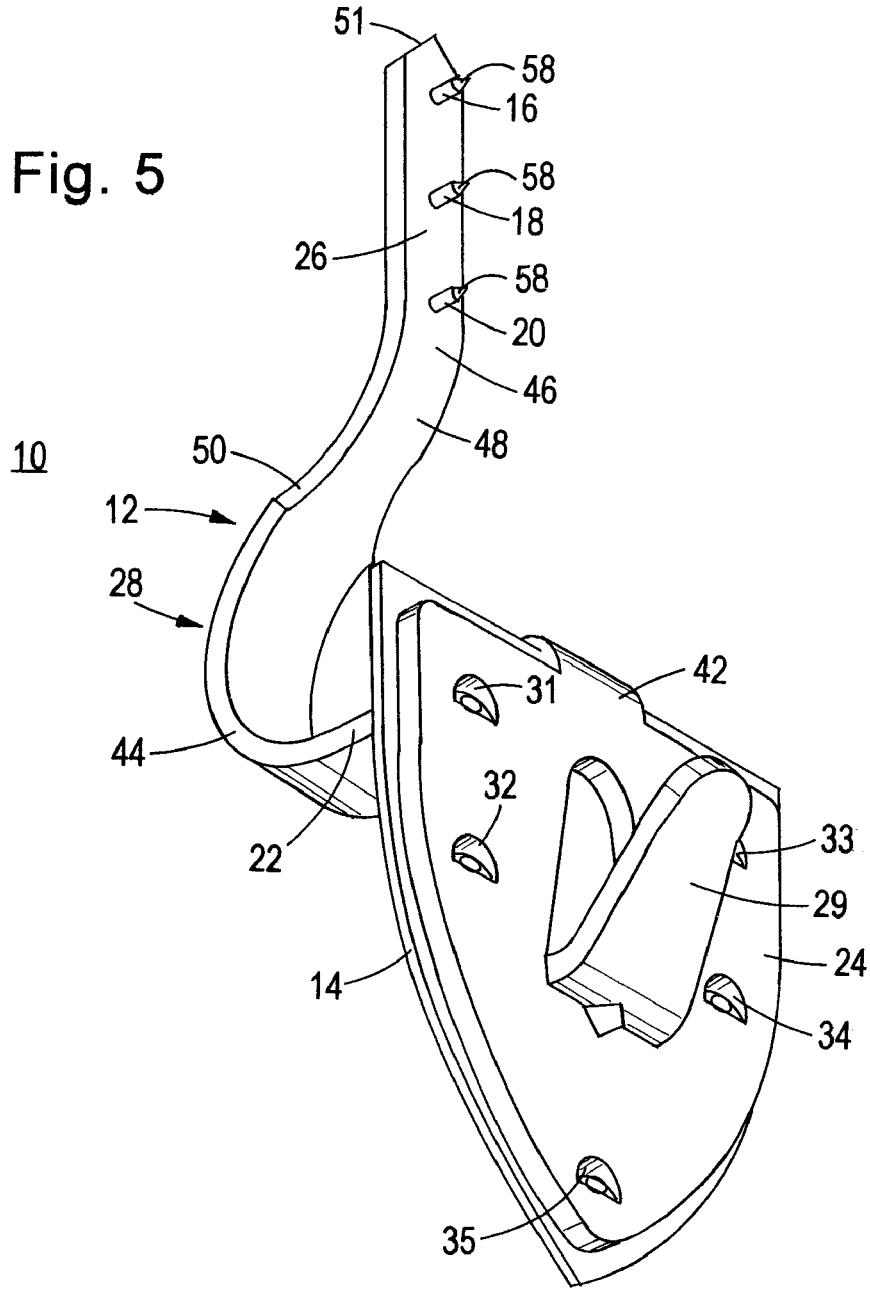
FIG. 5 is a perspective view, from the bottom, of the picture hanger illustrated in FIGS. 1-4.

The end of curved portion 44 remote from straight portion 48 is smoothly connected to the end of shoulder 22 that is remote from curved segment 42, and the end of curved portion 46 remote from straight portion 48, is smoothly connected to arm 26. The arcs of curved portions 44 and 46 are oppositely directed and are sectors of different circles having centers on opposite sides of the spring as illustrated in FIG. 2. Each circle has a radius of 0.50 inch (1.27 cm), and curved portions 44 and 46 respectively subtend angles of 50 degrees and 131 degrees. It has been found that this geometry enables spring 28 to impart the desired movement (described infra) to arm 26 in response to loads of between about 25 pounds (11.4 kg) and 280 pounds (127.3 kg) being applied to surface 30.

The bottom end of arm 26 is smoothly connected to the end of curved portion 46. Arm 26 and curved portion 46 have the same cross sectional dimensions and geometry at their intersection. The top of arm 24, which is remote from the intersection of the arm and curved portion 46, ends at point, i.e., tip, 51 which assists in inserting the arm into the hole in the drywall wall. The face of arm 26 which faces the back face of the drywall wall fixedly carries nails 16, 18 and 20 which pierce (impale) the back face of the drywall wall and extend into the wall in response to a load in excess of 25 pounds (11.4 kg) being exerted on load bearing surface 30. Nails 16, 18 and 20 (1) are vertically aligned with each other and point 51 on the center of arm 26 and displaced from each other along the length of the arm, (2) are preferably press fit into arm 26, and (3) each has a sharp pointed end 58 that digs into the drywall wall, through the back face of the drywall.

Mounting hanger 10 on drywall wall 62 (FIG. 6) involves making an initially somewhat small hole in wall 62 by inserting a suitable tool, such as a screw driver or drill bit, into the front (exterior) face 64 of wall 62 and then pushing the tool completely through the wall so the tool extends beyond back (interior) face 66 of the wall. The exterior dimensions of the hole made by the tool are preferably smaller than the dimensions in all directions of the cross section of arm 26. After the tool has been removed from wall 62 by pulling it out of front face 64, pointed end 51 is inserted into the hole through front face 64, with nails 16-20 pointing up. Pointed end 51 and arm 26 are pushed into the hole to enlarge the hole to form a slot having approximately the same cross sectional size and shape as the cross sectional size and shape of arm 26. As arm 26 is pushed between front face 64 and back face 66, nails 16-20 score the roof of the slot to form a narrow slit in the slot roof.

Figure 6:
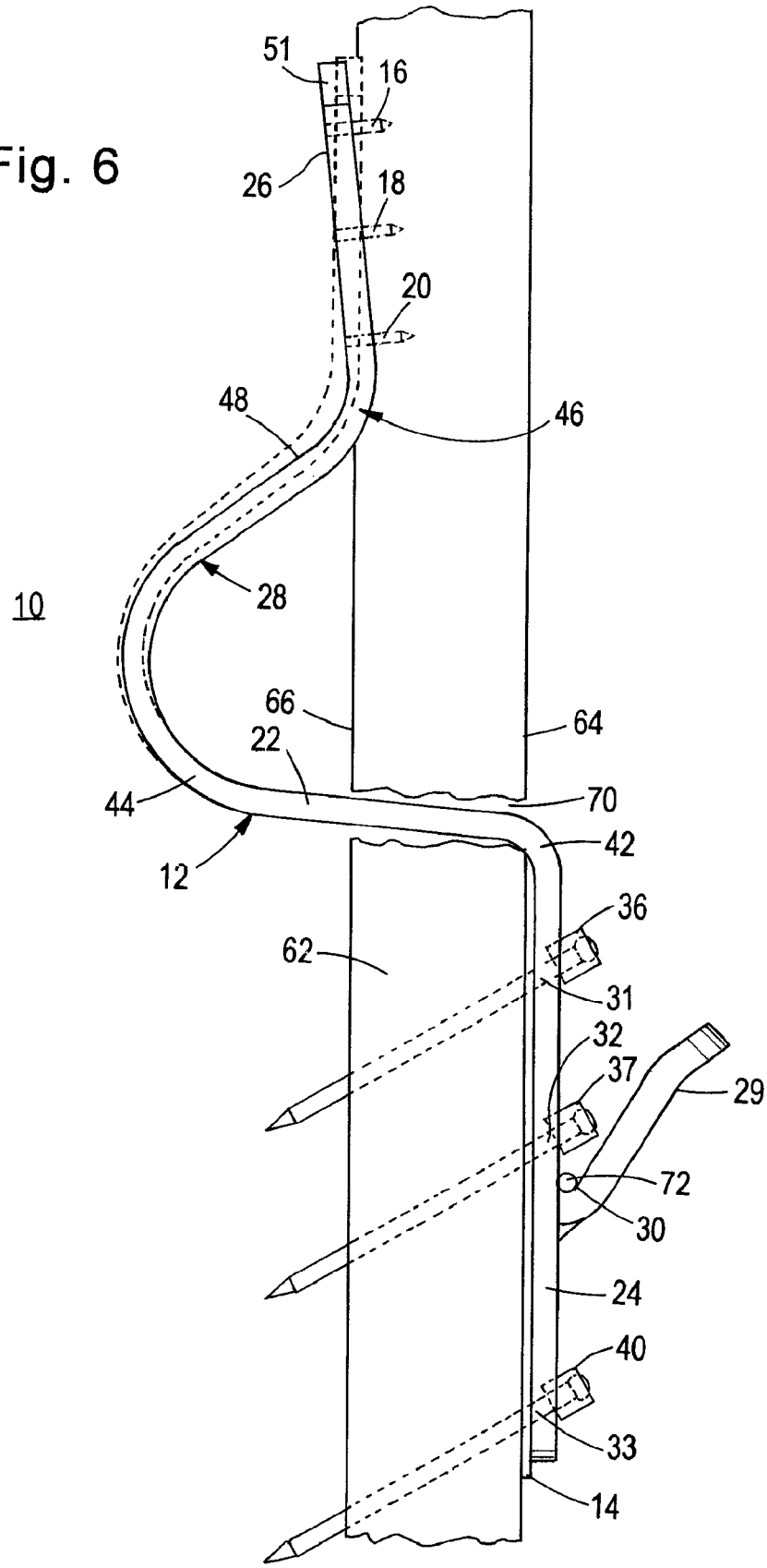
FIG. 6 is a side view of the picture hanger of FIGS. 1-5 as hung on a drywall wall.

The slot formed by arm 26 is enlarged by tapered walls 50 as hanger 10 is pushed farther into the slot and arm 26 is turned upwardly and toward wall 62. As a result, the slot formed by arm 26 is enlarged to form, between faces 64 and 66, a slot having approximately the same cross sectional size and shape as the cross sectional size and shape of spring 28 and shoulder 22. Spring 28 and shoulder 22 are pushed and turned in the slot until the exposed face of layer 14 abuts front face 64, as illustrated in FIG. 6. When the exposed face of layer 14 abuts front face 64, the cross sections of the slot in wall 62 are enlarged somewhat to form slot 70, having a rectangular shape and dimensions slightly larger than the dimensions of the cross sections of spring 28 and shoulder 22 so the shoulder fits somewhat snuggly in slot (i.e., hole) 70 in wall 62.

When the exposed face of layer 14 initially abuts front face 64, the turning moment on shoulder 22 at the contact region between the shoulder and a segment in the floor of the slot close to face 64 and the resilient nature of spring 28 result in arm 26 tilting away from back face 66 so pointed tip 51 is farther from back face 66 than the intersection of arm 26 and shoulder 22. As a result, the sharp pointed end 58 of nail 20 abuts back face 66 of wall 62 and the ends of nails 16 and 18 are displaced away from wall 62 so the ends of nails 16 and 18 are not in contact with face 66. In response to leg 24 having a suitable force applied to it, the end of shoulder 22 close to curved segment 42 pivots about a region on the floor of slot 70 close to front face 64. The force can be applied by driving one or more of nails 36-40 through nail holes 31-35 into wall 62 and/or by applying a load to load bearing surface 30, i.e., by putting on surface 30 a wire or cord carrying an object to be hung on hanger 10.

In response to (1) the turning moment resulting from the end of shoulder 22 close to curved segment 42 pivoting about the region on the floor of slot 70 close to front face 64 and (2) a restoring force spring 28 exerts on arm 26, the arm turns toward face 66 to cause sharp pointed ends 58 of nails 16-20 to pierce face 66 and be driven into wall 62. Thus, sharp pointed ends 58 of nails 16-20 dig into wall 62 and nails 16-20 provide a sufficiently secure connection of hanger 10 to wall 62 to enable the hanger to hold 220 pounds (100 kg) if none of nails 36-40 is driven into wall 62. If all of nails 36-40 are driven into wall 62 and nails 16-20 are fully driven into wall 62, the combination of nails 16-20 and 36-40 enables hanger 10 to hold 280 pounds (127.3 kg).

The solid line situation illustrated in FIG. 6 represents the deflection of hanger 10 and the position of nails 16-20 in response to a minimum load of about 25 pounds (11.4 kg) being applied to load bearing surface 30 by wire 72 and the object (not shown) to which the wire is attached. The dotted line situation illustrated in FIG. 6 indicates the position hanger 10 has if there is a full load (e.g., 280 pounds (127.3 kg)) on surface 30.

In the deflected condition illustrated by the full lines in FIG. 6, (1) tip 51 of arm 26 is not in contact with wall 62, (2) only a portion of nail 16 extends into wall 62, (3) nails 18 and 20 are fully driven into wall 62 and (4) the lower portion of arm 26 and the part of spring 28 adjacent arm 26 dig slightly into back face 66 of wall 62. As the load that wire 72 applies to surface 22 increases, the turning moment applied by the floor of slot 70 to shoulder 26 increases, causing arm 26 to turn so tip 51 moves closer to face 66. If the load that wire 72 applies to surface 30 is sufficiently large, the turning moment increases to a sufficient extent as to cause arm 26 to turn sufficiently to cause the entire length of the arm to abut face 66 so all of nails 16-20 are fully driven into wall 62.

Figure 8:
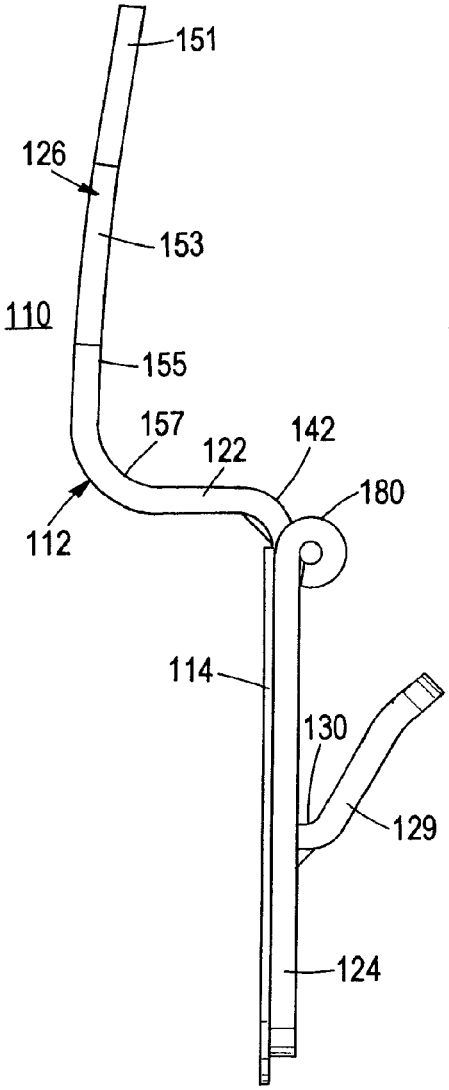
FIG. 8 is a side view of the picture hanger illustrated in FIG. 7.
Figure 7:
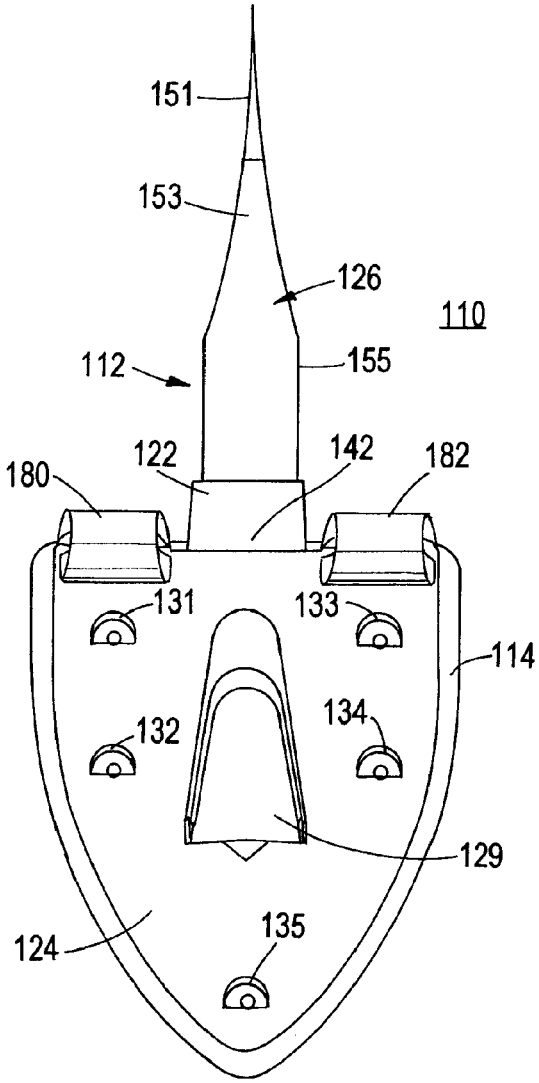
FIG. 7 is a front view of a picture hanger in accordance with a second preferred embodiment of the present invention.

Reference is now made to FIGS. 7 and 8, drawings of an uninstalled picture hanger 110 found, through experimentation, to hold loads up to 260 pounds (111.2 kg) on a ⅝ inch (1.59 cm) thick drywall wall. Picture hanger 110 consists of one-piece sheet metal structure 112 and shock absorbing layer 114. Shock absorbing layer 114 is fixedly attached to sheet metal structure 112 that includes planar shoulder 122, planar leg 124 and arm 126 including two planar segments that are slightly tilted relative to each other. In a preferred embodiment, structure 112 is made of 12 gauge (0.109 inch (i.e., 2.77 mm) thick) low carbon steel coated with brass plating. After a sheet metal blank that is to form structure 112 has been extruded, the blank is stamped and formed to the shape described infra.

When hanger 110 is installed on the drywall wall, shoulder 122 extends generally horizontally through a horizontal hole in the wall, between front and back faces of the wall. Leg 124 is connected to the end of shoulder 122, essentially at the front face of the wall, to extend vertically down from the end of the shoulder, parallel to the front face of the wall, against which layer 114 bears. Arm 126 extends generally vertically upward, away from shoulder 122, so the arm is along and impaled in the back face of the wall. Prior to hanger 110 being mounted in the wall, arm 126 is tilted toward leg 124 and displaced from leg 124 by a distance some what less than the thickness of the wall.

Shock absorbing layer 114 is in the form of soft rubber or soft high density polyurethane foam, preferably as disclosed by Weck et al., U.S. Pat. Nos. 6,059,124 and 6,095,465. Layer 114 is fixedly mounted (glued) on the rear planar face of leg 124, that is, the face of the leg facing toward the drywall on which hanger 110 will be mounted. Layer 114 extends beyond the edges of leg 124, which is shaped as a shield for aesthetic and product identification purposes.

Leg 124 includes tongue 129 that is stamped from the leg and extends from the front generally planar surface of the leg in a direction opposite from the back face of the leg and from the drywall. Tongue 129 includes load bearing surface 130 for receiving a long narrow structure, such as a metal wire, attached to the object to be hung on hanger 110. Tongue 129 preferably is configured as disclosed by Weck et al., U.S. Pat. Nos. 6,629,680 and 6,758,455.

Leg 124 also includes five holes 131-135 through which elongated fasteners, preferably case hardened nails, (not shown) are inserted and driven into the drywall behind layer 114. Holes 131 and 132 are on the left side of tongue 129, holes 133 and 134 are on the right side of tongue 129 and hole 135 is directly below the center of tongue 129 which is equally spaced from the side edges of leg 124. Nails 136-140 are used for maximum loads. If the load is less than the maximum, fewer or no nails may be necessary.

Leg 124 includes collets (i.e., circular flanges) 180 and 182, equally spaced from the center longitudinal axis of leg 124 on opposite sides of shoulder 122. One end of each of collets 180 and 182 extends from and is integrally attached to the top edge of leg 124. The other, free end of each of collets 180 and 182 includes an edge that bears against the front face of leg 124, close to the top edge of the leg. The free ends of collets 180 and 182 are on opposite sides of shoulder 122. Collets 180 and 182 add strength and rigidity to leg 124.

Shoulder 122 is smoothly connected to and angularly displaced from leg 124 by an angle slightly less than 90 degrees, preferably 88 degrees, as a result of the center of the top edge of leg 124 being connected to the front portion of shoulder 122 by curved segment 142 of structure 112; shoulder 122 and segment 142 have the same cross sectional rectangular dimensions and geometry. Because of the angle between shoulder 122 and leg 124, when shoulder 122 is horizontally positioned in the hole in the wall and a load is applied to load bearing surface 130, the bottom surface of the shoulder at the front end of the hole, next to the front face of the wall, rests on the bottom surface i.e., floor, of the hole in the wall, and the top surface of the shoulder at the back end of the hole, next to the back face of the wall, bears against the top surface, i.e., roof, of the hole.

Arm 126 has a very sharply pointed, dagger like upper planar end 151 that pierces and extends into the back face of the wall when shoulder 124 is located in the hole in the wall between the front and back faces of the wall. The walls of upper end 151 are continuously tapered. The bottom part of upper end 151 extends from the planar middle part 153 of arm 126 that also has continuously tapered walls. As viewed from the front of hanger 110, the tapers of the walls of upper end 151 and middle part 153 are continuous and smooth at the intersection between upper end 151 and middle part 153.

Figure 9:
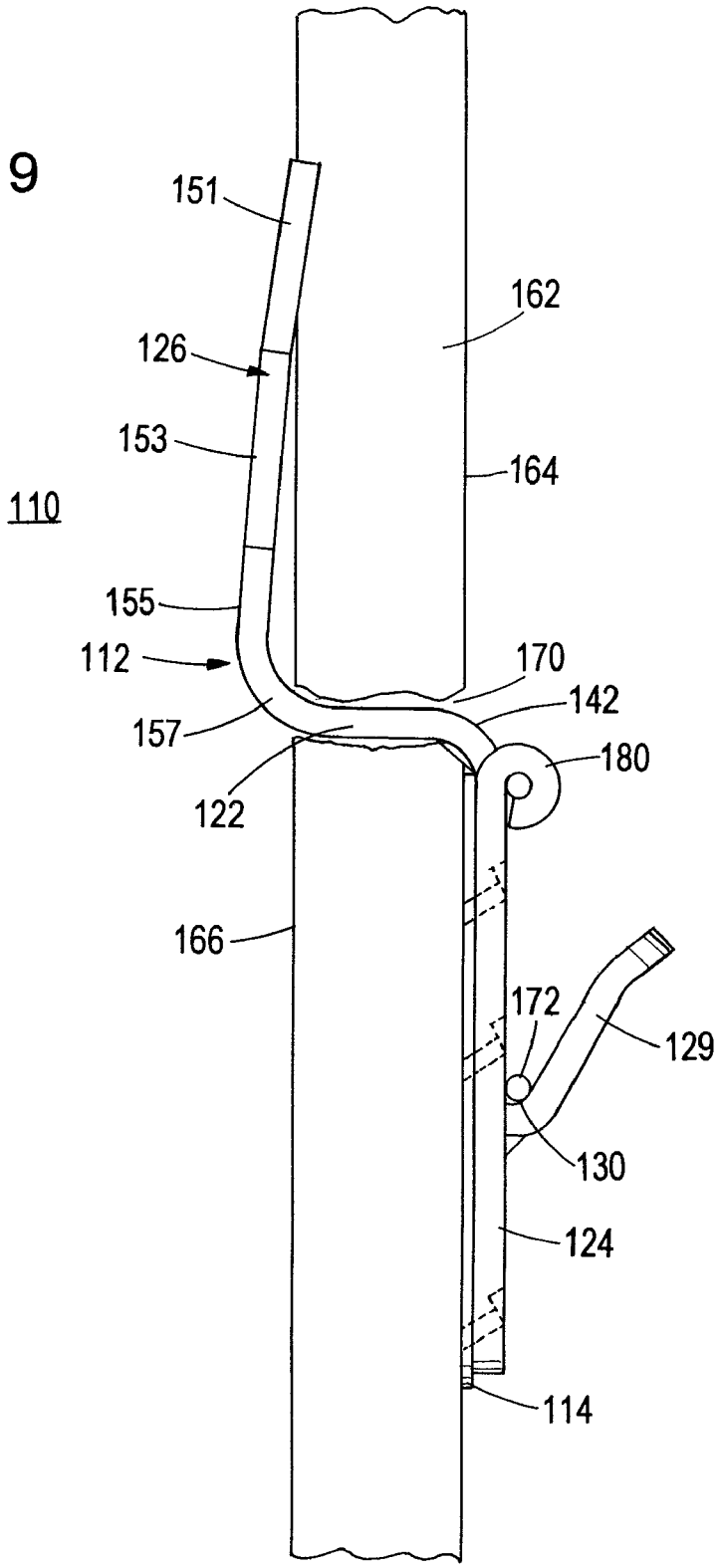
FIG. 9 is a side view of the picture hanger illustrated in FIGS. 7 and 8, as hung on a drywall wall.
Figure 10:
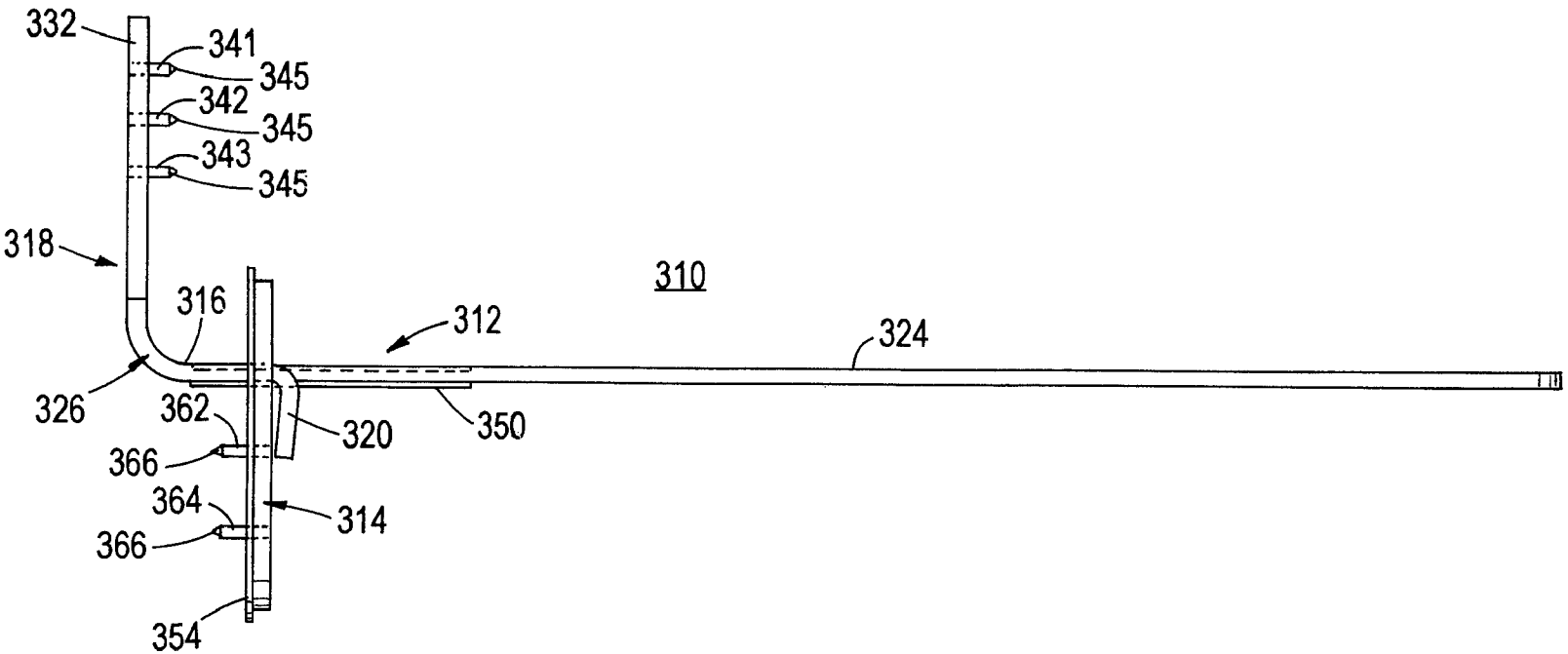
FIG. 10 is a side view of a shelf hanger in accordance with another preferred embodiment of the present invention.
Figure 11:
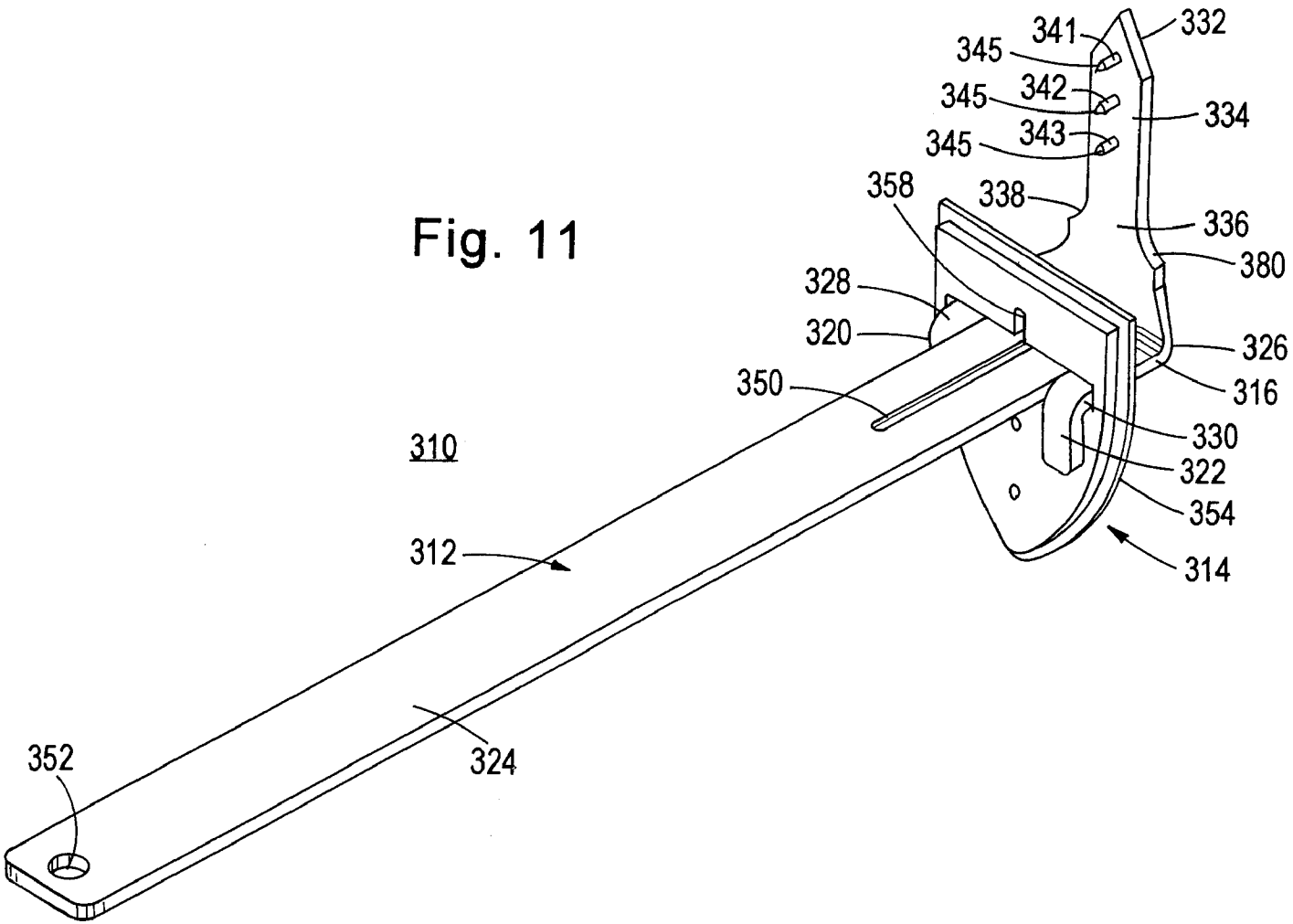
FIG. 11 is a perspective view, from the top and the right side, of the shelf hanger illustrated in FIG. 10.
Figure 12:
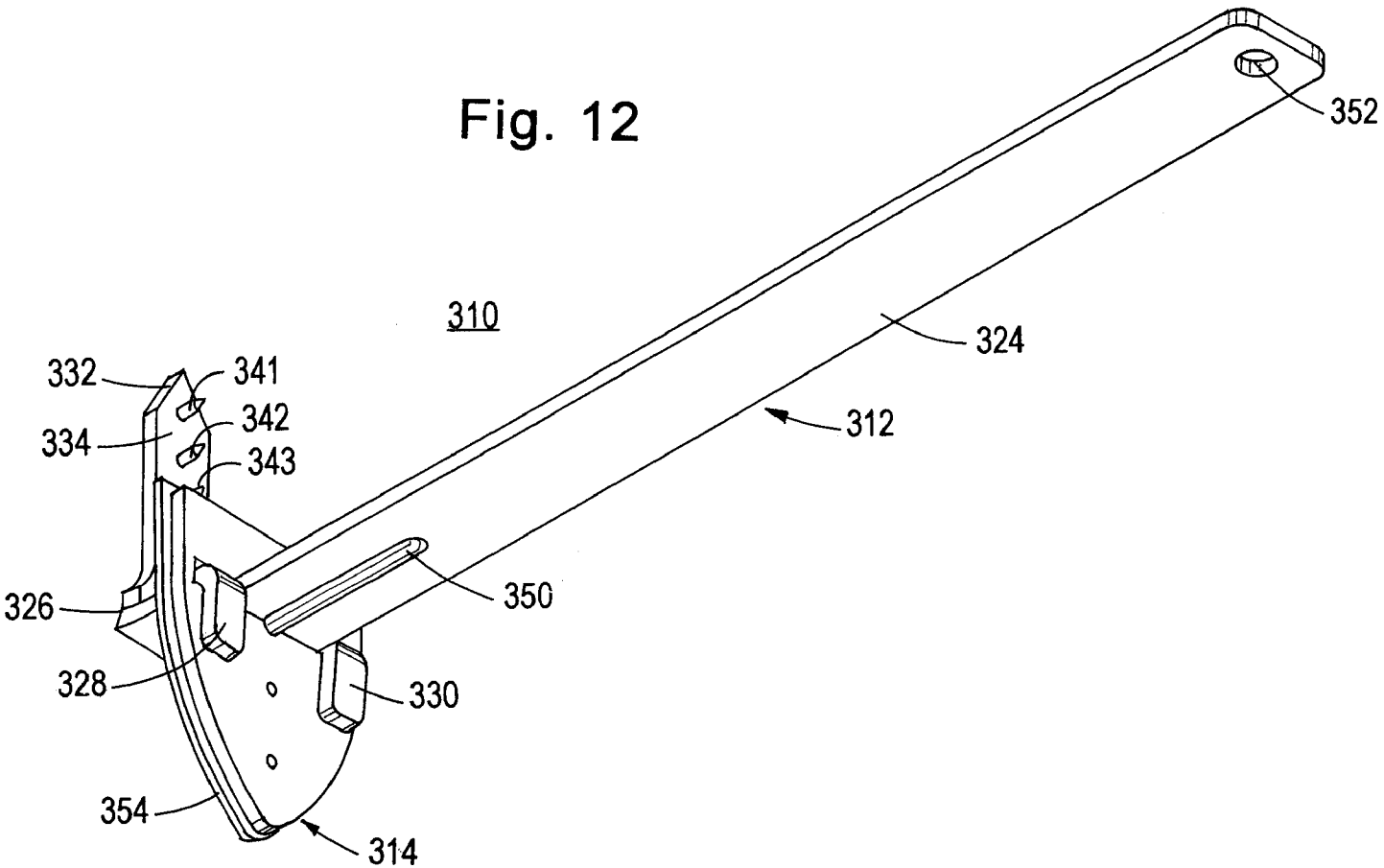
FIG. 12 is a perspective view, from the bottom and the left side, of the shelf hanger illustrated in FIGS. 10 and 11.
Figure 14:
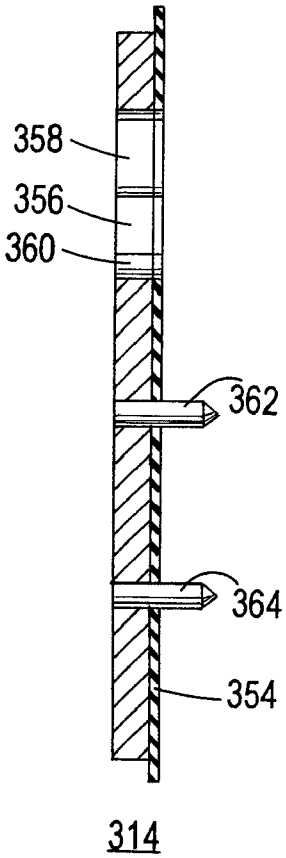
FIG. 14 is a cross-sectional view, taken along the lines 14-14, of FIG. 13.
Figure 13:
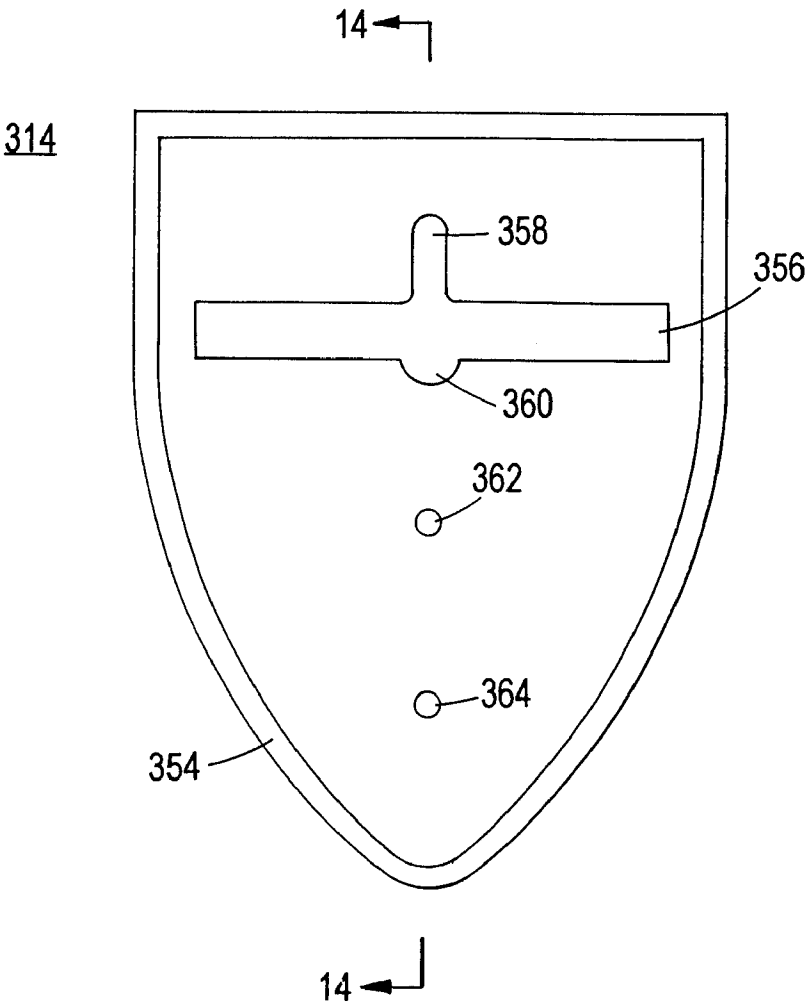
FIG. 13 is a front view of a preferred embodiment of a plate included in the shelf hanger illustrated in FIGS. 10-12.
Figure 15:
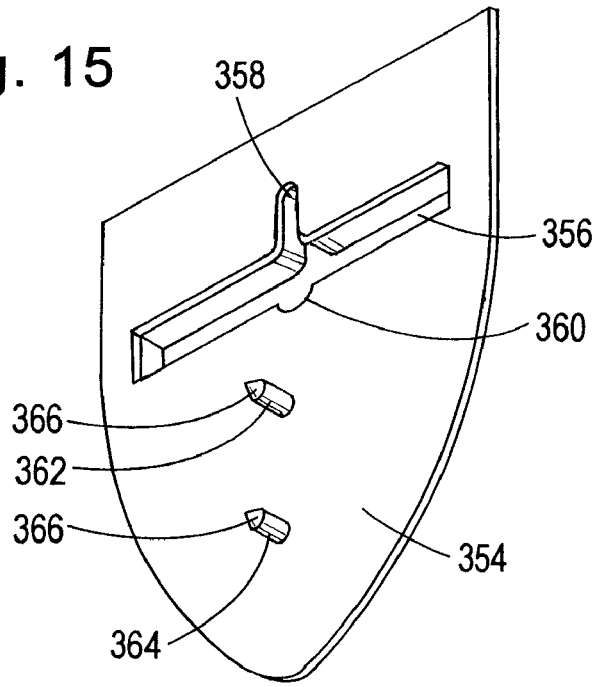
FIG. 15 is a rear perspective view of the plate illustrated in FIGS. 13 and 14.
Figure 16:
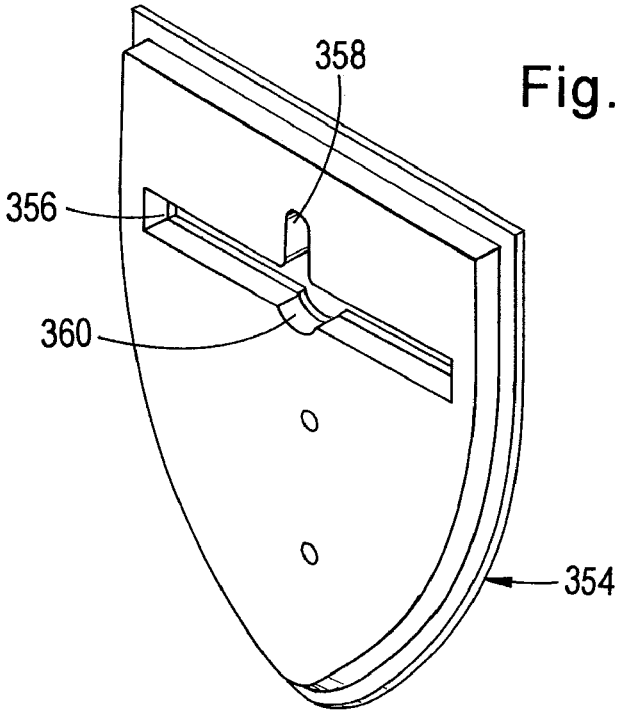
FIG. 16 is a front perspective view of the plate illustrated in FIGS. 13-15.
Figure 17:
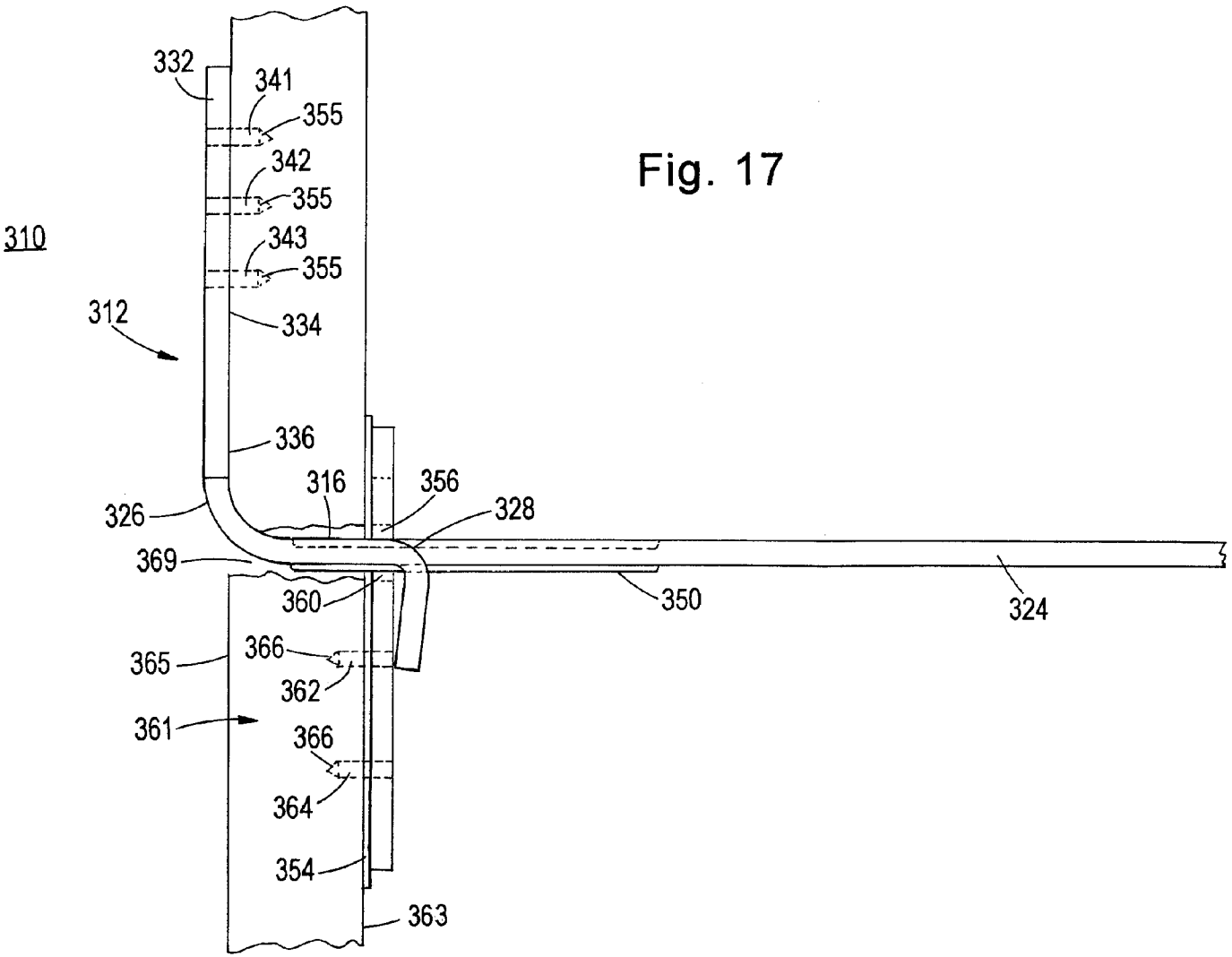
FIG. 17 is a side view of the shelf hanger of FIGS. 10-12, as hung on a drywall.

Upper end 151 of arm 124 is tilted slightly toward leg 124 relative to middle part 153 of the arm, in the preferred embodiment by 4 degrees, to enhance the digging of the sharp pointed tip of end 151 into the back face of the wall. The lower part 155 of arm 124, which has rectangular cross sections having the same dimensions and shape as the cross sections of shoulder 122, includes rounded portion 157 that smoothly connects arm 126 to shoulder 122. Shoulder 122, rounded portion 157, lower portion 155 and middle portion 153 of arm 126 are such that the middle portion is tilted toward leg 124 relative to shoulder 122 so the angle between the shoulder and middle portion of arm 126 is less than 90 degrees, and is 84 degrees in the preferred embodiment. The angular relation between shoulder 122 and arm 126 and the tilting of upper end 151 relative to middle portion 153 result in the tip of the upper end of arm 151 piercing the back face of the drywall wall under no load conditions on load bearing surface 130, as illustrated in FIG. 9. As load is added to surface 130 there is greater digging into the wall by the sharp tip at the upper end of arm 151.

Because of (1) the sharp tip at the upper end 151 of arm 126, (2) the tapered walls of the upper end and middle portion 153 and (3) the rigidity collets 180 and 182 impart to leg 124, many installers are able to install hanger 110 in a drywall, such as wall 162, FIG. 9, without using a tool other than the hanger. Such installation is performed by the installer grasping leg 124 with one or both hands and pushing the sharp tip of upper end 151 of arm 126 horizontally against and into front face 164 of wall 162. After arm 126 has been pushed completely through wall 162 to form a hole in the wall, the installer pushes leg 124 down so (1) layer 114 abuts the wall front face 164 to cause shoulder 122 to seat and extend horizontally in hole 170 made by arm 126 and (2) the sharp tip at the upper end 151 of arm 126 pierces back face 166 of wall 162 and extends into the wall. A similar procedure can also be performed by using a tool, such as a screwdriver or drill, to form the hole through the wall prior to insertion of hanger 110 into the hole.

After hanger 110 has been seated in hole 170 in drywall 162, one or more of the case hardened nails, as necessary, is hammered into the wall through holes 131-135; for some loads no nails need to be hammered into the wall through holes 131-135. Then a wire 172 or cord attached to the object to be hung on hanger 110 is placed on load bearing surface 130, causing the portion of shoulder 122 engaging the floor of hole 170 to pivot about a region on the floor close to the front face of the wall. In response to the portion of shoulder 122 engaging the floor of hole 170 pivoting about the region on the floor close to the wall front face 164, arm 126 turns toward the wall back face 166, causing the sharp tip at end 151 of arm 126 to dig farther into the back of the wall to provide a secure connection between hanger 110 and wall 162. It has been found that hanger 110 can hold loads of 260 pounds (111.2 kg) on load bearing surface 130 if five nails 136-140 are hammered into drywall wall 162 through holes 131-135.

Reference is now made to FIGS. 10-17 wherein shelf hanger 310 for a drywall wall is illustrated as including one piece hanger or bracket 312 and one piece support plate 314 which stabilizes the position of bracket 312 on the drywall, particularly to keep bracket 312 perpendicular to the wall, and helps to hold bracket 312 on the wall. For somewhat light loads on bracket 312, support plate 314 is not necessary.

In a preferred embodiment, bracket 312 and plate 314 are made of 12 gauge (0.109 inch (2.77 mm) thick) low carbon steel coated with brass plating. After a sheet metal blank that is to form bracket 312 has been extruded, the blank is stamped and formed to the shape described infra.

Bracket 312, when installed on a drywall wall, includes horizontally extending shoulder 316, upwardly extending arm 318, downwardly extending legs 320 and 322 and horizontally extending elongated tongue 324 which is essentially an extension of shoulder 316. The bottom face of the shelf which is to be carried by hanger 310 is placed on and rests on tongue 324. If support plate 314 is not employed, there is reduced clearance between the inner walls of legs 320 and 322 and the walls of shoulder 316 relative to the clearance indicated by FIGS. 11 and 12.

Shoulder 316, when installed in the drywall wall, extends horizontally through a horizontal hole in a drywall wall, between the front and back faces of the wall. The end of shoulder 316 next to the back, that is, interior, face of the wall is connected to the lower end of arm 318 by curved segment 326 of bracket 312; segment 326 subtends an angle of 90° so that shoulder 316 and arm 318 are at right angles to each other. The end of shoulder 316 next to the front, that is, exterior, face of the wall is connected by curved segments 328 and 330 to legs 320 and 322, which are on opposite sides of tongue 324, which extends between the legs.

The outer walls of legs 320 and 322, that is, the walls of the legs remote from tongue 324, are aligned with the outer walls of shoulder 316. Curved segments 328 and 330 subtend an angle that is slightly less than 90°, preferably 85°, so that the free lower ends of legs 320 and 322 that are remote from shoulder 316 are tilted toward the plane of the front face of the drywall wall.

Arm 318 includes a pointed upper end 332, a middle portion 334 having straight parallel walls and a lower portion 336 having outwardly tapered walls 338; the bottom end of lower portion 336 intersects curved segment 326. Vertically aligned nails 341-343, having sharp pointed ends 345, are fixedly mounted on the face of arm 318 facing toward the back face of the drywall wall. Nails 341-343 are (1) aligned with the tip of upper end 332, (2) mounted on upper end 332, and (3) attached to arm 318 by press fitting. Nails 341-343 pierce the back face of the drywall wall upon initial insulation of bracket 312 and extend farther into the wall during installation and loading of the bracket to provide a secure connection between the bracket and the wall.

Strengthening rib 350 extends longitudinally along the common center line of tongue 324 and shoulder 316. Rib 350 longitudinally extends below the common, aligned lower faces of shoulder 316 and tongue 324, so there is a corresponding depression in the upper face of the shoulder and tongue. Circular hole 352, at the end of tongue 324, receives a bolt or screw for holding in place the shelf which is mounted on tongue 324. In one embodiment, the length of tongue 324 is about 8⅓ inches (21.16 cm), the length of rib 350 is about 1⅝ inches (4.13 cm), the width of shoulder 316 is about 1¼ inches (3.175 cm), and the width of tongue 324 is about ¾ inch (1.90 cm).

As discussed supra, sheet metal plate 314 is optionally employed. When employed, plate 314 is fixedly mounted on the front face of the drywall wall to support and stabilize the position of bracket 312. Plate 314 is shaped as a shield for product recognition and aesthetic purposes, and includes, on its face which abuts the front face of the drywall wall, shock absorbing layer 354, preferably made of soft rubber or soft high density polyurethane foam, preferably as disclosed by Weck et al., U.S. Pat. Nos. 6,059,124 and 6,095,465.

Plate 314 includes horizontally extending slot 356 having (1) its center on the longitudinal centerline of the plate and (2) a length slightly greater than the distance between the outer walls of legs 320 and 322. Extending upwardly from the center of slot 356 is slit 358 having a length and width sufficient to enable through passage of nails 341-343. Extending downwardly from the center of slot 356 is circular arcuate cutout 360 which corresponds in shape with and accommodates rib 350. Hence, plate 314 can be slipped over arm 318, shoulder 316 and the portion of tongue 324 between legs 320 and 322 prior to installation of hanger 310 in the drywall wall.

Vertically aligned nails 362 and 364, having sharp pointed ends 366, are fixedly mounted, by press fitting, on the centerline of plate 314. Nails 362 and 364 project through layer 354 to pierce the front face of the drywall wall, into which they are driven by hand pushing or hammering on the face of plate 314 remote from the front face of the drywall wall.

Hanger 310 is installed by forming, in the drywall wall where the hanger is to be mounted, e.g., drywall wall 361 (FIG. 17), a slot having sufficient width to accommodate shoulder 316. One way of forming such a slot is to drill several adjacent, horizontally aligned holes in drywall 361 so the perimeters of the holes are slightly spaced from each other. With (1) the face of shield 314 opposite from layer 354 in place against the back faces of legs 320 and 322, (2) arm 318 horizontally oriented, and (3) nails 341-343 and tongue 324 facing upwardly, the installer places the pointed end 332 of arm 318 against the horizontally aligned holes. The installer then pushes pointed end 332 against the holes, to punch out the remaining drywall between the adjacent perimeters of the holes formed by drilling, to form a slot having approximately the same shape and dimensions as the cross-section of upper end 332 and middle portion 334 of arm 318. The roof of such a slot is scored as a result of sharp ends 345 of nails 341-343 moving through the drywall.

The installer then pushes arm 318 farther into the slot formed by upper end 332 and middle portion 334 so that outwardly tapered walls 338 at the lower portion 336 of arm 318 cut the drywall and expand the width of the slot so that the width of the slot becomes slightly greater than the width of shoulder 316 between the opposite walls of the shoulder. As walls 338 expand the width of the slot, the installer turns tongue 324 downwardly to form enlarged hole or slot 369. By the time shoulder 316 enters enlarged slot 369 the shoulder and tongue are horizontal and the upper and lower faces thereof are in the same planes as the roof and floor of slot 369, respectively.

The installer then pushes shoulder 316 and tongue 324 farther into slot 369. As a result, legs 320 and 322 push plate 314 toward front face 363 of the drywall wall 361. This action is continued until nails 362 and 364 of plate 314 begin to pierce the front face 363 of the drywall wall 361. The installer then pushes or hammers plate 314 until layer 354 abuts the front face 363 of the drywall wall 361 to complete the installation process.

With the installation process completed, the inner walls of legs 320 and 322 respectively abut the opposite walls of tongue 324, rib 350 sits in arcuate cutout 360 of plate 314, the outer walls of legs 320 and 322 abut the vertical walls of slot 356, the bottom face of tongue 324 rests on the floor of slot 356, and the upper face of tongue 324 is close to the roof of slot 356. As a result, the position of bracket 312 is stabilized by plate 314.

Nails 341-343, which dig into the back face 365 of drywall wall 361 in response to pivoting of shoulder 316 about a region of the floor of the slot close to the front face of the drywall wall, are significantly responsible for enabling bracket 312 to hold shelves with substantial loads. Pivoting of shoulder 316 about the region of the floor of the slot close to the front face 363 of the drywall wall is in response to a shelf bearing against and loading tongue 324, the top face of which is a load bearing surface.

Legs 320 and 322 also contribute significantly to the ability of bracket 312 to hold heavy loads. The bottom faces of legs 320 and 322, next to shoulder 316, bear against the floor of the slot in the drywall wall so that as the load on tongue 324 increase legs 320 and 322 transfer greater force to the drywall. Consequently the areas of the bottom faces of legs 320 and 322 that bear against the floor of slot 369 and the length of the slot can be considerably greater than illustrated in FIGS. 10-12. Legs 320 and 322 also contribute to the ability of bracket 312 to carry a heavy load because the bottom ends of the legs bear against plate 314 which transfers the force exerted by the bottom ends of the legs to drywall 361 via the front face 363 of the drywall. Plate 314 prevents legs 320 and 322 from possibly punching through the drywall, particularly for heavy loads. If plate 314 is not employed, a possibility for light loads, the bottoms of the legs bear directly against the front face of the drywall wall so the force resulting from loading of tongue 324 is applied by the bottom ends of the legs directly to the wall.

Plate 314 can be modified so it is easier to install bracket 312, such that the plate is installed on the bracket after the bracket has been installed in the drywall wall. A first such modification involves forming the plate so that the portion of the plate above the roof of slot 356 is not extant, such that the top of the plate includes a notch having sides and a floor which are the same as the sides and floor of slot 356. In such a configuration, the plate is slipped into place under tongue 324 and shoulder 316 so that rib 350 is seated in a cutout of the modified plate corresponding to cutout 360, and the plate is between the back faces of legs 320 and 324 and the front face of the drywall wall, after bracket 312 has been positioned in the slot of the drywall wall.

Figure 18:
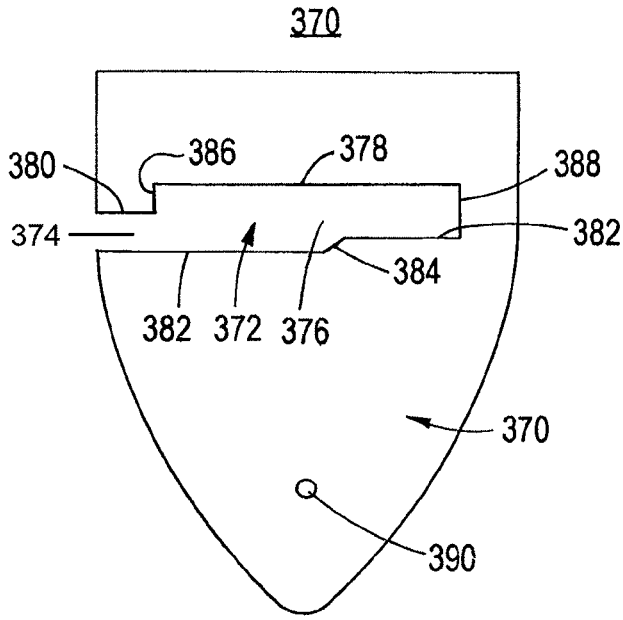
FIG. 18 is a back view of a second embodiment of a plate that can be employed with the bracket of FIGS. 10-12, instead of the plate illustrated in FIG. 13-16.
Figure 19:
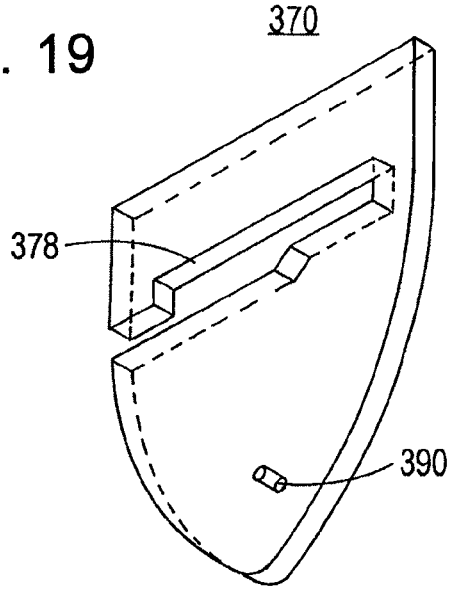
FIG. 19 is a perspective view, from the back, of the plate illustrated in FIG. 18.

FIGS. 18 and 19 are respectively aback view and a back perspective view of plate 370, a second modification of plate 314 that provides greater positional stability than the first modification and greater ease of installation than plate 314. For clarity, the shock absorbing layer which is on plate 170, and is similar to layer 354, is not included in FIGS. 18 and 19.

Plate 370 includes slot 372 having an opening 374 that extends from elongated slot portion 376 in the center of the plate to the exterior wall of the plate. Opening 374 has a rectangular shape and a height slightly greater than the common height of tongue 324 and shoulder 316 so the interior portion 376 of slot 372 can be slipped over the shoulder. Interior portion 376 has (1) a straight horizontally extending roof 378 that is vertically offset in an upward direction from roof 380 of opening 374 and (2) a floor including a straight horizontally extending lower segment 382 that is aligned with and a continuation of the floor of opening 374. The floor of interior portion 376 includes upwardly extending ramp 384 leading to segment 382 of floor portion 376.

Opening 374 and slot 372 are constructed so opening 374 can be slipped on shoulder 316 and/or tongue 324, between legs 320 and 322 and the front face of the drywall wall after bracket 312 has been inserted in the slot in the wall. After opening 374 has been inserted on shoulder 316 and/or tongue 324, plate 370 is translated horizontally until ramp 384 engages the wall of the shoulder and/or tongue, at which time plate 370 is pushed downwardly by ramp 384, to slide down the engaged wall, causing the shoulder and/or tongue to be nested, i.e., captured, in slot 372 between walls 386 and 388 of interior portion 376 of slot 372.

Plate 370 is then secured to the drywall wall by driving, into the front face of the drywall wall, nail 390, fixedly mounted by press fitting, on the face of plate 370 that abuts the front face of the drywall wall. As a result, tongue 324 is securely held in place on the drywall wall in slot 372 with about the same degree of stability as attained by plate 314, but with a much easier installation of plate 370 relative to plate 314.

While there have been described and illustrated several specific embodiments of the invention, it will be clear that variations in the details of the embodiments specifically illustrated and described can be made without departing from the true spirit and scope of the invention, as defined in the appended claims.

The invention claimed is:

1. A hanger for hanging an object on a wallboard wall, the wall having a hole between front and back faces of the wall through which a portion of the hanger is adapted to extend, the hole including a bottom portion, the hole being formed either in response to the hanger portion being inserted through the hole or prior to insertion of the hanger portion through the hole, the hanger comprising: a one-piece member having (a) a shoulder having a bottom portion adapted to bear against the bottom portion of the hole and to extend horizontally through the hole, the hanger portion including the shoulder, (b) an arm extending upwardly relative to the shoulder while the shoulder extends horizontally through the hole, (c) a leg extending downwardly from the shoulder while the shoulder extends horizontally through the hole, (d) a load bearing surface for receiving the object; the arm including a sharp pointed end, extending substantially horizontal from a surface of the arm facing the back face of the wall, for digging into the back face of the wall while the shoulder extends horizontally through the hole; the arm, shoulder, leg and load bearing surface being arranged so that while the shoulder extends horizontally through the hole and sufficient weight is applied by the object to the load bearing surface: (a) the leg is outside the front face of the wall, (b) a portion of the shoulder proximate the leg pivots about a segment of the bottom portion of the hole proximate the front face of the wall for causing the leg to pivot toward the front face of the wall, and (c) the arm bears against the back face of the wall for causing the sharp pointed end to dig into the back face of the wall and fixedly hold the arm against the wall in response to the pivoting of the shoulder, the sharp pointed end comprises a plurality of said sharp pointed ends at different locations along the arm between the end of the arm and the shoulder each sharp pointed end having a fixed orientation with respect to the shoulder, and the sharp pointed end protrudes from the arm at a location between the shoulder and an end of the arm remote from the shoulder.

2. The hanger of claim 1 wherein the sharp pointed end is at an end of the arm opposite from the shoulder and is tilted slightly toward the back side of the wall relative to the remainder of the arm to extend substantially vertically into the back face of the wall while the shoulder extends horizontally through the hole.

3. The hanger of claim 1 wherein the arm includes a spring arrangement between the shoulder and a portion of the arm carrying the sharp pointed end.

4. The hanger of claim 3 wherein the spring arrangement has an arcuate shape between the shoulder and the portion of the arm carrying the sharp pointed end, the arcuate shape having curves so that a first portion of the arcuate shape extends from the shoulder to a point beyond the portion of the arm carrying the sharp pointed end and a second portion of the arcuate shape extends from the point to the portion of the arm carrying the sharp pointed end.

5. The hanger of claim 4 wherein the spring arrangement is such that in response to the object exerting sufficient load on the load bearing surface a force is exerted on the arm to cause the sharp pointed end to dig into the back face of the wall.

6. The hanger of claim 1 wherein the arm includes a spring arrangement between the shoulder and a portion of the arm carrying the sharp pointed end.

7. The hanger of claim 6 wherein the spring arrangement is such that in response to the object exerting sufficient load on the load bearing surface a force is exerted on the arm to cause the sharp pointed end to dig into the back face of the wall.

8. The hanger of claim 1 wherein the leg includes a hook arranged to extend away from the wall while the shoulder extends horizontally through the hole, the hook including the load bearing surface.

9. The hanger of claim 1 further including a fastener arrangement for digging into the front face of the wall and for fixedly mounting the leg to the wall.

10. The hanger of claim 1 wherein the load bearing surface is on a tongue horizontally aligned with the shoulder and extending away from the front and back faces while the shoulder extends horizontally through the hole, and the one piece member includes two of said legs, said two legs being outside opposite longitudinally extending edges of the tongue.

11. The hanger of claim 10 further including a plate that is not part of the one piece member, the plate being arranged to be fixedly mounted on and bear against the front face of the wall and support the tongue and to be between the front face of the wall and the legs while the shoulder extends horizontally through the hole.

12. The hanger of claim 11 wherein the plate includes a slot through which the shoulder and legs extend while the shoulder extends horizontally through the hole, the slot having an opening in the periphery of the plate, the plate and one piece member being arranged for enabling the plate to be slid through the opening over the arm and shoulder and against portions of the legs prior to insertion of the hanger portion through the hole.

13. The hanger of claim 12 wherein the sharp pointed end is arranged to face toward the back face of the wall and extend substantially horizontally into the back face of the wall while the shoulder extends horizontally through the hole.

14. The hanger of claim 11 wherein the tongue includes a rib that extends downwardly from the remainder of the tongue while the shoulder extends horizontally through the hole, the plate including a notch into which the rib extends while the plate is fixedly mounted on the front face of the wall and the shoulder extends horizontally through the hole.

15. The hanger of claim 11 further including a fastener arrangement for digging into the front face of the wall and for fixedly mounting the plate to the wall.

16. The hanger of claim 1 further including an arrangement for enabling a fastener to be inserted through the leg into the front face of the wall to hold the one-piece member to the wall.

17. In combination, a wallboard wall having a hole therein between front and back faces of the wall, the hole having a bottom portion; a hanger, fixedly mounted on the wall, for hanging an object on the wallboard wall, the hanger comprising: a one-piece member having (a) a shoulder having a bottom portion bearing against the bottom portion of the hole and extending horizontally through the hole, (b) an arm extending upwardly relative to the shoulder, (c) two legs (i) extending downwardly from the shoulder, and (ii) located outside the front face of the wall, and (d) a load bearing surface for receiving the object, wherein the load bearing surface is on a tongue horizontally aligned with the shoulder and extending away from the wall, said two legs being outside opposite longitudinally extending walls of the tongue; the arm including a sharp pointed end, extending substantially horizontal from a surface of the arm facing the back face of the wall, piercing the back face of the wall and extending into the wall via the back face of the wall, the sharp pointed end having a fixed orientation with respect to the shoulder, and the sharp pointed end extends from the arm at a location between the shoulder and an end of the arm remote from the shoulder.

18. The combination of claim 17 wherein the sharp pointed end is at an end of the arm opposite from the shoulder and is slightly tilted toward the wall relative to the remainder of the arm so the sharp pointed end extends almost vertically into the back face of the wall.

19. The combination of claim 17 wherein the leg includes a hook extending away from the wall, the hook including the load bearing surface.

20. The combination of claim 17 further including a plate that is not part of the one piece member, the plate being fixedly mounted on and bearing against the front face of the wall and being between the front face of the wall and the legs, the hanger having a bottom surface bearing on a surface of the hanger.

21. The hanger of claim 20 wherein the hanger includes a downwardly extending rib engaging and held in place by a corresponding surface of the plate.

22. The combination of claim 17 the plurality of said sharp pointed ends are at different locations along the arm between the end of the arm and the shoulder and extend horizontally into the wall between the end of the arm remote from the shoulder and the shoulder.

* * * * *